United States Patent [19]

Keller

[11] Patent Number: 4,750,728

[45] Date of Patent: Jun. 14, 1988

[54] APPARATUS FOR LOADING A PROCESSING MEANS FOR PROCESSING FLEXIBLE FLAT PRODUCTS, ESPECIALLY PRINTED PRODUCTS

[75] Inventor: Alex Keller, Eschenbach, Switzerland

[73] Assignee: Ferag AG, Hinwil, Switzerland

[21] Appl. No.: 804,519

[22] Filed: Nov. 21, 1985

[30] Foreign Application Priority Data

Nov. 26, 1984 [CH] Switzerland ..... 5628/84

[51] Int. Cl.[4] ..... B65H 1/30

[52] U.S. Cl. ..... 271/161; 198/626; 271/200; 271/214

[58] Field of Search ..... 271/213, 214, 209, 150, 271/161, 200, 201, 205, 178; 198/626, 627, 649.1, 628

[56] References Cited

U.S. PATENT DOCUMENTS

| | | | |
|---|---|---|---|
| 2,884,243 | 4/1959 | Stobb | 271/178 |
| 2,933,314 | 4/1960 | Stobb | 271/215 |
| 4,050,467 | 9/1977 | Van Slvis et al. | 198/626 X |
| 4,558,859 | 12/1985 | Duke et al. | 271/200 |
| 4,601,688 | 7/1986 | Kopczynski | 271/161 X |
| 4,618,136 | 10/1986 | Pessina et al. | 198/627 X |

*Primary Examiner*—Andres Kashnikow

*Assistant Examiner*—Matthew C. Graham

*Attorney, Agent, or Firm*—Werner W. Kleeman

[57] ABSTRACT

Flat products, such as printed sheets, resting in the form of a horizontal stack on two circulatingly driven transport chains are conveyed towards a retention plate serving as a stop of a feeder or feeder attachment. Two circulatingly driven toothed belts are laterally arranged above the transport chains and these two toothed belts define the sides of a conveying channel. The toothed belts hold the printed sheets in their mutually related positions inside the loose stack during their forward displacement. The distance between the mutually facing runs of the toothed belts is less than the width of the printed sheets or the stack of printed sheets. The toothed belts and therefore also the conveying channel terminate at a distance from the retention plate. The printed sheets are held in a curved or bowed configuration in the conveying channel. As soon as the printed sheets leave the conveying channel, the rearwardly bent lateral edges of the printed sheets return into their original position due to their inherent elasticity. In this manner each of the printed sheets is separated from the next following sheet. The printed sheets are conveyed towards the retention plate in a loosened formation. Consequently, a reliable withdrawal of individual printed sheets from the stack is ensured.

15 Claims, 1 Drawing Sheet

APPARATUS FOR LOADING A PROCESSING MEANS FOR PROCESSING FLEXIBLE FLAT PRODUCTS, ESPECIALLY PRINTED PRODUCTS

CROSS-REFERENCE TO RELATED APPLICATION

This application is related to the commonly assigned, copending U.S. patent application, Ser. No. 06/624,365, filed June 25, 1984, now U.S. Pat. No. 4,657,237 and entitled "Method of, and Apparatus for, Producing Stacks of Flexible Flat Products, Especially Printed Products", the disclosure of which is incorporated herein by reference now U.S. Pat. No. 4,657,237, granted Apr. 14, 1987.

BACKGROUND OF THE INVENTION

The present invention broadly relates to a new and improved construction of an apparatus for loading or charging processing means for processing flexible and substantially flat products, such as printed products and the like.

In its more particular aspects, the present invention specifically relates to a new and improved construction of an apparatus for loading or charging processing means for processing flexible and substantially flat products, especially printed products, and comprises longitudinally extending supporting means for supporting a reclining stack formed of flexible products having a substantially flat configuration. The apparatus further contains an arrangement for forwardly displacing or advancing the flat products in the stack along the supporting means in a direction towards a predetermined withdrawal location.

A loading apparatus for loading a feeder or feeder attachment is known, for example, from the Swiss Pat. No. 584,642, granted Feb. 15, 1977, and contains a stack support formed by two serially-arranged pairs of conveying chains. The printed sheets to be processed are placed upon the transporting or conveying chains in the form of a compressed stack and are conveyed by means of the conveying chains towards a retention plate. Since the printed sheets are so tightly compressed in the stack that they cannot be stripped off without danger of disruption, special measures must be taken when using this known method in order to loosen the printed sheets relative to each other prior to withdrawing them. For this purpose that pair of conveying chains situated closer to a stop is downwardly angled or bent as compared with the other pair of conveying chains, so that the conveying path is bent. While passing through this bent portion of the conveying path, the printed sheets in the stack are fanned out or separated. However, the loosening effect thus achieved is still insufficient and therefore two guide plates are arranged in the region of this bent portion of the conveying path. The two guide plates are arranged opposite each other with respect to the conveying path and extend upwardly in the region of such bent portion. The distance between the guide plates is greater than the width of the flat products or printed sheets in the stack. Adjusting screws are screwed into these guide plates, and are adjusted such that their tips protrude to some extent into the conveying path of the printed sheets.

In a loading apparatus as described in the German Patent Publication No. 3,425,397, and which is cognate with the initially mentioned and herein cross-referenced U.S. patent application Ser. No. 06/624,365, now U.S. Pat. No. 4,657,237, printed sheets are not placed on supporting means in the form of a compressed stack, but are individually and consecutively pushed onto the rear of the stack. In this manner a looser stack is formed. However, the danger exists that the printed sheets, during their forward displacement, may slide or slip away or flip over or change their position within the stack in an unpredictable manner, since the printed sheets are not pressed against each other. However, a compression of the printed sheets in order to prevent this phenomena is undesirable for the same reasons recited in relation to the apparatus according to the aforementioned Swiss Pat. No. 584,642.

SUMMARY OF THE INVENTION

Therefore, with the foregoing in mind, it is a primary object of the present invention to provide a new and improved apparatus for loading processing means for processing flexible and substantially flat products, especially printed products, which does not exhibit the aforementioned drawbacks and shortcomings of the prior art constructions.

Another and more specific object of the present invention is to provide an apparatus in which the flat products arrive at a predetermined withdrawal location in a much looser formation in the stack without danger of disruption of the arrangement of the flat products within the stack.

Now in order to implement these and still further objects of the invention which will become more readily apparent as the description proceeds, the apparatus of the present invention is manifested by the features that the arrangment for advancing the products comprises two conveying elements arranged opposite each other with reference to a conveying channel for the flat products and above the supporting means convey the products in a direction which extends towards the predetermined withdrawal location or retention plate and that their mutual separation distance is less that the width of the stack.

The products are forwardly displaced in the stack by the lateral conveying elements while still retaining their loose formation. The lateral conveying elements are preferably constructed as circulatingly drivable conveying belts. In this way the flat products are held in their lateral position by the conveying elements and at the bottom by the supporting means, so that the formation of the flat products within the stack remains constant during forward displacement.

Though it need not be the case, if the supporting means comprise at least one circulatingly drivable conveying means, then it is practical for this circulatingly drivable conveying means to be driven such that its circulating speed is at least approximately the same as the conveying speed of the conveying elements. In this way, relative motion between the supporting means and the flat products which are being forwardly displaced by the conveying elements is avoided.

Due to the fact that the distance between the laterally arranged conveying elements is less than the width of the flat products, respectively of the stack, the flat products are bent or bowed during their forward displacement through the conveying channel laterally defined or bounded by the conveying elements. This leads to an enhanced positional stability of the flat products. If the conveying elements terminate at a predetermined spacing from the withdrawal location or retention plate, then the marginal or edge regions of the flat products, due to their inherent elasticity, return back or snap into their original straight condition as soon as the flat products leave the conveying channel just before the withdrawal location or retention plate. Consequently, the flat products loosen themselves in the region of their marginal or side edges from subsequent products, which results in an additional loosening of the flat products in the already loose stack in a region immediately in front of the withdrawal location or retention plate. This results in a further enhancement of the certainty of withdrawing only a single product from the stack.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENT

Figure 1:
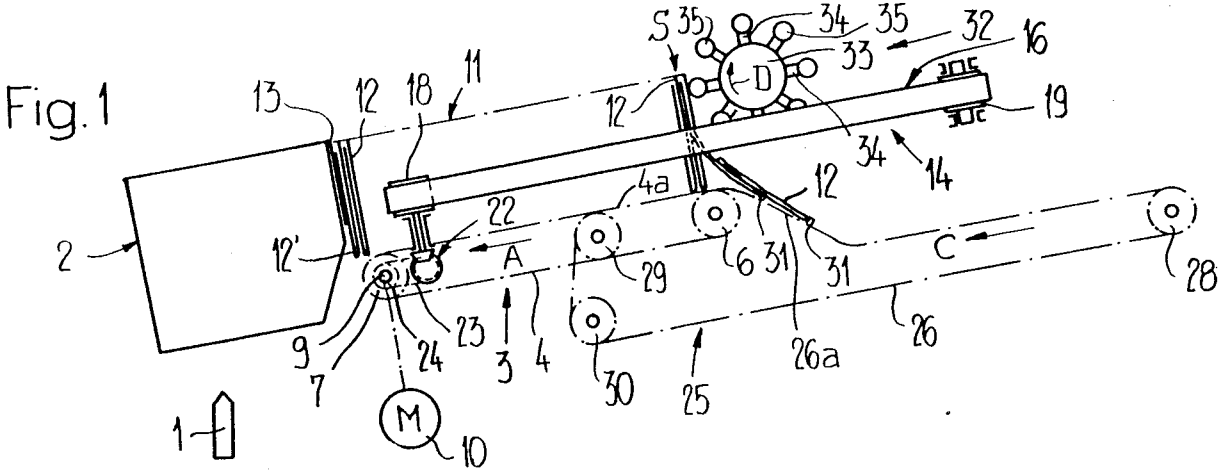
FIG. 1 shows a side view of an apparatus for loading a feeder.
Figure 2:
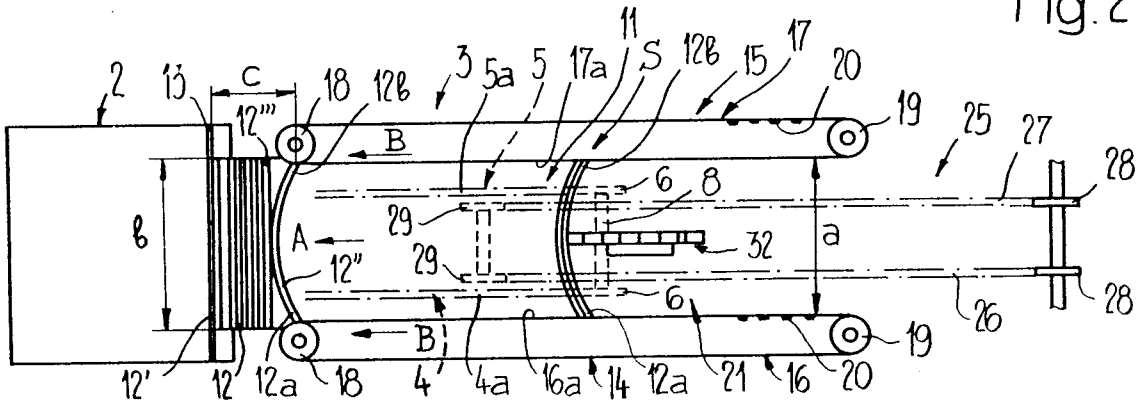
FIG. 2 shows a top plan view of the loading apparatus for the feeder.

Describing now the drawings, it is to be understood that to simplify the showing thereof only enough of the structure of the apparatus for loading processing means for processing flexible flat products, especially printed products, has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a collecting chain or belt indicated by the reference numeral 1 and belonging to a collating machine or an accumulative stapling machine. Along this collecting chain or belt 1 a number of feeders or feeding attachments 2 are arranged, in a manner known per se, one behind the other. These feeders 2, only one of which is purely schematically depicted in FIGS. 1 and 2, are of a known type and can, for example, correspond to the feeders described in the previously mentioned Swiss Pat. No. 584,642.

In front of each feeder or feeding attachment 2 there is arranged a loading or charging apparatus 3 which possesses two transport chains 4 and 5 or equivalent structure which extend at a distance from each other. Each transport chain 4 and 5 is guided or conducted over deflection wheels or sprockets 6 and 7. These deflection wheels or sprockets 6 and 7 are mounted in pairs on respective shafts 8 and 9. The shaft 9 is driven by a driving motor 10 such that respective upper runs 4*a* and 5*a* of the transport chains 4 and 5 are moved in the direction of the arrow A. The transport chains 4 and 5, which are somewhat inclined from the horizontal, serve as the supporting means for a reclining stack 11 which may, for instance, comprise flexible and substantially flat products, such as folded printed sheets 12. The transport chains 4 and 5 push the printed sheets 12 towards a retention plate 13 which constitutes a stop or stop means. The currently foremost printed sheet 12' lying firmly against the retention plate or stop 13, is stripped off or withdrawn in known manner by the feeder or feeding attachment 2 from the stack 11 and deposited astride the collecting chain or belt 1.

Conveying elements 14 and 15 are arranged laterally and above the transport chains 4 and 5. These conveying elements 14 and 15, starting at a predetermined distance or spacing from the retention plate or stop 13, extend rearwardly. Each conveying element 14 and 15 comprises a respective endless conveyor belt 16 and 17 which, in the exemplary embodiment being described, consists of a toothed belt. Each toothed endless conveyor belt 16 and 17 is guided or conducted around two deflection wheels 18 and 19 which it engages with its toothing 20. This toothing 20 lies on the inside of the toothed belts 16 and 17 and is shown in Figure 2. The two mutually facing runs 16*a* and 17*a* of the respective toothed belts 16 and 17 extend essentially parallel to each other and lie or extend in a fixed position laterally of a conveying channel 21 shown in FIG. 2 for the printed sheets 12 of the stack 11. The distance or spacing a of these mutually facing runs 16*a* and 17*a* is less than the width b of the printed sheets 12 and therefore of the stack 11, as also shown in FIG. 2. The printed sheets 12, which are situated between the guide or conveying elements 14 and 15, are consequently bent or bowed backwards in the region of their marginal or side edges or edge regions 12*a* and 12*b* and assume a substantially U and V form in the stack 11 as can also be seen from FIG. 2.

As can be seen from FIG. 1, the deflection wheels 18 are driven by the motor 10 via a bevel gear transmission or drive 22. A driving chain 23 is guided or conducted over a chain wheel or sprocket 24 mounted on the shaft 9. Thus, the toothed belts 16 and 17 are circulatingly driven such that the mutually facing runs 16*a* and 17*a* are moved in the direction of the arrow B (FIG. 2), that is, in the conveying direction A of the printed sheets 12. Therefore the conveying speed of the toothed belts 16 and 17 essentially corresponds to the circulating speed of the transport chains 4 and 5. On their external sides the toothed belts 16 and 17 possess an adhesive surface.

While at the front end of the stack 11 the printed sheets 12 are individually stripped off or withdrawn as hereinbefore described, at the rear end, i.e. the end remote from the retention plate or stop 13, the printed sheets 12 are loaded onto the stack 11. This procedure is described in the aforementioned German Patent Publication No. 3,425,397, which, as stated, corresponds to the aforementioned commonly assigned, copending U.S. patent application Ser. No. 06/624,365, filed June 25, 1984 now U.S. Pat. No. 4,657,237, granted Apr. 14, 1987.

An apparatus 25 for supplying and loading the printed sheets 12 is only shown schematically in the drawings and corresponds in construction and function to the arrangement described in the previously mentioned German Patent Publication No. 3,425,397 and U.S. Pat. No. 4,657,237. The supply and loading apparatus 25 possesses two conveying components 26 and 27 extending in mutually spaced parallel relationship and each conveying component 26 and 27 is guided over chain wheels or sprockets 28, 29 and 30. One of these chain wheels or sprockets, for example the chain wheel or sprocket 28, is driven in a conventional manner, not therefore particularly shown in the drawings, such that the conveying components 26 and 27 circulate in the direction of the arrow C, as shown in FIG. 1. Carrier lugs 31 are arranged at regular distances along each conveying component 26, 27, of which carrier lugs 31 only two are shown in FIG. 1. The rear ends or transverse edges of the printed sheets 12, which are supplied in imbricated formation, lie against these carrier lugs 31. As can be seen from FIG. 1 the conveying components 26 and 27 possess a section 26a which rises up towards the stack 11 and this has the effect that the printed sheets 12 are guided up against the rear of the stack and are upwardly loaded onto the stack 11. In the region of this rising section 26a the marginal or edge regions 12a and 12b of the printed sheets 12 are bent upwardly as is described in greater detail in the previously mentioned German Patent Publication No. 3,425,397 and the cognate U.S. patent application Ser. No. 06/624,365, now U.S. Pat. No. 4,657,237. Consequently, the printed sheets 12 are already bowed or bent into a substantially U or V form when they are pushed upwardly between the toothed belts 16 and 17.

A carrier or support device 32 acts upon the rear of the stack 11 and possesses a carrier or support disc 33 which, in a manner known per se and therefore not here further described, is circulatingly driven in the direction of the arrow D. Eight radially extending arms 34 are fixed to this carrier or support disc 33. These eight radially extending or radial arms 34 are arranged at equal angles from each other and extend outwardly from the carrier or support disc 33. At their free ends these radially extending or radial arms 34 carry freely rotatably mounted pressure or compacting rolls 35. When loading printed sheets 12 onto the stack 11, the carrier or support device 32 acts on the stack 11 by means of one of the pressure or compacting rolls 35 without the carrier or support device 32 acting on the printed sheet 12 during such time as the printed sheet 12 is being loaded. This procedure is described in the above-mentioned German Patent Publication No. 3,425,397, and the cognate U.S. patent application Ser. No. 06/624,365, now U.S. Pat. No. 4,657,237.

As can be seen from FIGS. 1 and 2, the toothed belts 16 and 17 extend rearwardly beyond a loading position or location S for the printed sheets 12. In this manner it can be ensured that the stack 11 is always arranged with its entire rear region between the toothed belts 16 and 17.

Since the stack 11, as mentioned previously, is formed by the loading or infeed of printed sheets 12 at its rear end, the printed sheets 12 in the stack 11 are loosely arranged. The pressure applied by the carrier or support device 32 on the stack 11 is not great enough to compress the printed sheets 12 tightly against each other. The laterally arranged conveying elements 14 and 15 now ensure that the printed sheets 12 do not, on the one hand, mutually displace or flip over and, on the other hand, are not pressed against each other during their forward displacement through the conveying channel 21. The printed sheets 12 are held or retained laterally at their lateral edges or regions 12a and 12b by the toothed belts 16 and 17 while retaining their mutual positions within the stack 11 and are simultaneously pushed or displaced through and supported in the conveying channel 21 while reposing with their transverse edges extending between the lateral edges 12a and 12b upon the transport chains 4 and 5, as shown in FIG. 1. Thus, the printed sheets 12 are conveyed towards the retention plate or stop 13 in the correct position for an impeccable withdrawal of the printed sheets 12 and are also mutually loose within the stack 11.

During the advance or displacement of the printed sheets 12 in the stack 11 through the conveying channel 21 defined by the laterally limiting toothed belts 16 and 17, the marginal or lateral edges or edge regions 12a and 12b of the printed sheets 12, as previously mentioned, are bent or bowed backwards, that is, the printed sheets 12 are held in a curved or bowed position between the toothed belts 16 and 17. As already described and also shown in FIG. 2, the conveying channel 21 terminates or ends at a predetermined distance or spacing c in front of the retention plate or stop 13. On leaving the conveying channel 21, the marginal or lateral edges or edge regions 12a and 12b of the printed sheets 12, due to their inherent elasticity, bend back or snap into their normal position which means that the printed sheets 12 again assume a substantially planar or straight position. In FIG. 2 a printed sheet indicated by the reference numeral 12" is in the process of moving out of the conveying channel 21 and of coming to bear against the previous printed sheet 12''' which has already again reassumed a straight position. The backward movement of the marginal or lateral edges or edge regions 12a and 12b of the respective printed sheet 12 leaving the conveying channel 21 lifts or moves the printed sheet 12 away from the subsequent printed sheet 12. Consequently, an additional loosening of the printed sheet 12 between the end of the conveying channel 21 and the retention plate or stop 13 is achieved. Since the printed sheets 12 situated in the conveying channel 21 are supported laterally against the toothed belts 16 and 17 the portion of the stack 11 which is in the conveying channel 21 only loads the retention plate or stop 13 by a reduced amount. The loosened printed sheets 12 are pressed against the retention plate or stop 13 with only a low pressure with the attendant advantage that the printed sheets 12 can be taken over by the feeder or feeding attachment 2 without any difficulty.

It is to be understood that various components of the loading or charging apparatus 3 can be constructed differently than those which are shown and described. For example, instead of the toothed belts 16 and 17, untoothed or plain flat belts or V-belts can be utilized. However, in such an alternate embodiment the danger exists that, due to friction, the circulating speed of these belts will not correspond to the circulating speed of the transport chains 4 and 5, with the result that relative motion can occur between the belts, respectively the transport chains 4 and 5 and the printed sheets 12, which under certain circumstances is undesirable.

Instead of loading the printed sheets 12 continuously onto the stack 11 arranged between the lateral conveying elements 14 and 15 as described, it would, in certain circumstances, also be conceivable to load a prepared loose stack onto the supporting means behind the entry or inlet of the conveying channel 21 formed by the conveying elements 14 and 15 and to push the prepared loose stack through the conveying channel 21. During or before entry into the narrower conveying channel 21, the marginal or edge regions 12a and 12b of the printed sheets 12 would then be bent backwards.

Instead of constructing the supporting means of the stack 11 from circulating driven transport chains 4 and 5 as described, it would also be possible to use a fixedly positioned supporting means with a friction resistant i.e. low friction supporting surface. In such an exemplary embodiment the advance of the printed sheets 12 would take place exclusively by means of the lateral conveying elements 14 and 15.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for loading a processing means for processing flexible and substantially flat printed products having spaced lateral edges and an intermediate transverse edge extending between the spaced lateral edges, comprising:

an elongate supporting means for supporting a reclining stack of the flexible and substantially flat printed products at each of the transverse edges thereof;

said elongate supporting means comprising at least one circulatingly driven transporting component;

means for advancing the flexible and substantially flat printed products of said reclining stack along said elongate supporting means while the transverse edges of the printed products repose on the elongate supporting means toward a product withdrawal location;

said advancing means comprising two conveying elements arranged above said elongate supporting means and in mutually opposed spaced relationship to define therebetween a conveying channel for said flexible and substantially flat printed products;

said two conveying elements having a conveying direction extending towards said product withdrawal location; and said mutually spaced conveying elements having a predetermined spacing therebetween which is less than the width of said reclining stack which is defined by the distance between the lateral edges of the printed products.

2. The apparatus as defined in claim 1 wherein:

each said conveying element comprises at least one circulatingly driven conveying belt.

3. The apparatus as defined in claim 2 wherein:

each said at least one circulatingly driven conveying belt is formed as a toothed belt.

4. The apparatus as defined in claim 1 wherein:

each said conveying element possesses a substantially adhesive outside surface.

5. The apparatus as defined in claim 1 further including:

a retention plate for defining said product withdrawal location;

said mutually spaced conveying elements terminating at a predetermined spacing from said retention plate; and said retention plate acting as stop means from which said flexible and substantially flat printed products are withdrawn from said reclining stack.

6. The apparatus as defined in claim 1, wherein:

each of said two mutually spaced conveying elements extends in a substantially horizontal direction.

7. The apparatus as defined in claim 1 wherein:

said mutually spaced elements have a first circulating speed;

said at least one circulatingly driven transporting component having a second circulating speed; and said first circulating speed at least approximating said second circulating speed.

8. The apparatus as defined in claim 1 further including:

means for upwardly loading said flexible and substantially flat printed products onto said reclining stack at an end thereof located remote from said product withdrawal location.

9. The apparatus as defined in claim 8 wherein:

said conveying elements extend rearward at least to a loading location for said flexible and substantially flat printed products.

10. The apparatus as defined in claim 1, wherein:

said mutually spaced conveying elements having said predetermined spacing therebetween which is less than said reclining stack bending the substantially flat printed products rearwards at the region of said spaced lateral edges thereof and in a direction away from said product withdrawal location to loosen individual ones of said flexible and substantially flat printed products of the reclining stack from one another while maintaining said flexible and substantially flat printed products in substantially surface to surface contact.

11. The apparatus as defined in claim 10, wherein:

said mutually spaced conveying elements terminating at a predetermined spacing from said product withdrawal location; and said mutually spaced conveying elements conveying said rearwardly bent substantially flat printed products in the direction of said product withdrawal location and releasing said rearwardly bent substantially flat printed products at a location of termination of said mutually spaced conveying elements which is disposed upstream of said product withdrawal location to allow said rearwardly bent substantially flat printed products to be propelled in the direction of said product withdrawal location and to again straighten out their bent configuration into a substantially flat configuration and with said substantially flat printed products bearing against one another in substantially full surface to surface contact while being postured in a substantially upright position.

12. The apparatus as defined in claim 10, further including:

means for continuously driving said mutually spaced conveying elements so as to continuously convey said rearwardly bent substantially flat printed products in the direction of said product withdrawal location.

13. The apparatus as defined in claim 10, further including:

means for driving said mutually spaced conveying elements so as to travel at essentially the same speed of movement.

14. The apparatus as defined in claim 10, wherein:

said two conveying elements of said mutually spaced conveying elements having said predetermined spacing therebetween which is less than said reclining stack comprising substantially parallelly extending conveying elements wherein said predetermined spacing between said substantially parallel conveying elements remains essentially constant.

15. An apparatus for loading a processing means for processing flexible and substantially flat printed products having spaced lateral edges and an intermediate transverse edge extending between the spaced lateral edges, comprising:

supporting means for supporting a reclining stack of the flexible and substantially flat printed products at each of the transverse edges thereof;

means for advancing the flexible and substantially flat printed products of said reclining stack along said supporting means while the transverse edges of the printed products repose on the supporting means and toward a product withdrawal location;

said advancing means comprising two conveying elements arranged above said supporting means and in mutually opposed spaced relationship to define therebetween a conveying channel for said flexible and substantially flat products;

said two conveying elements having a conveying direction extending towards said product withdrawal location; and said mutually spaced conveying elements having a predetermined spacing therebetween which is less than the width of said reclining stack defined by the distance between the lateral edges of the printed products in order to rearwardly bow said flexible and substantially flat printed products in a direction away from said product withdrawal location so as to loosen said flexible and substantially flat printed products from one another in the reclining stack while maintaining the same substantially in full surface to surface contact.

* * * * *